US009265311B2

(12) United States Patent
Hasenfeld et al.

(10) Patent No.: US 9,265,311 B2
(45) Date of Patent: Feb. 23, 2016

(54) CUSHION CUT GEMSTONE WITH EXCELLENT OPTICAL BRILLIANCE

(71) Applicant: Hasenfeld-Stein, Inc., New York, NY (US)

(72) Inventors: Hertz Hasenfeld, NY, NY (US); Zyshe Lorincz, NY, NY (US)

(73) Assignee: HASENFELD-STEIN, INC., New York, NY (US)

( * ) Notice: Subject to any disclaimer, the term of this patent is extended or adjusted under 35 U.S.C. 154(b) by 8 days.

(21) Appl. No.: 14/138,805

(22) Filed: Dec. 23, 2013

(65) Prior Publication Data

US 2015/0173469 A1 Jun. 25, 2015

(51) Int. Cl.
*A44C 17/00* (2006.01)

(52) U.S. Cl.
CPC ..... *A44C 17/001* (2013.01)

(58) Field of Classification Search
CPC ..... A44C 17/001; A44C 17/00
USPC ..... 63/32; D11/90
See application file for complete search history.

(56) References Cited

U.S. PATENT DOCUMENTS

| | | | | |
|---|---|---|---|---|
| D494,087 | S | 8/2004 | Lax | |
| D494,090 | S | 8/2004 | Lax | |
| D494,091 | S | 8/2004 | Lax | |
| D494,092 | S | 8/2004 | Lax | |
| D502,122 | S | 2/2005 | Lax | |
| 7,146,827 | B2 | 12/2006 | Mardkha | |
| D566,608 | S * | 4/2008 | Sinclaire | D11/90 |
| D639,202 | S | 6/2011 | Gavin | |
| 2011/0302960 | A1 * | 12/2011 | Weingarten | 63/32 |
| 2013/0213090 | A1 | 8/2013 | Ritchie | |

FOREIGN PATENT DOCUMENTS

| | | | |
|---|---|---|---|
| WO | WO 2010/078265 | A2 | 7/2010 |
| WO | WO 2012/164410 | A1 | 12/2012 |

OTHER PUBLICATIONS

Notification of Transmittal of the International Search Report and The Written Opinion of the International Searching Authority, or the Declaration, issued for PCT/US14/69987, date of mailing Mar. 13, 2015.

* cited by examiner

*Primary Examiner* — Abigail Morrell
(74) *Attorney, Agent, or Firm* — Arent Fox LLP

(57) ABSTRACT

A gemstone including a substantially rectangular girdle with rounded corners, a crown extending in a first direction from the girdle, and a pavilion extending in a second direction from the girdle opposite the first direction. The gemstone has 69 uniquely arranged and angled facets, 41 of which are in the crown, and 28 of which are in the pavilion. The height of the crown is preferably between 12 to 19½% of the width of the stone, the total depth of the stone is preferably between 58-68% of the width of the stone, and the width of the table is preferably between 55-65% of the width of the stone.

12 Claims, 3 Drawing Sheets

CUSHION CUT GEMSTONE WITH EXCELLENT OPTICAL BRILLIANCE

FIELD OF THE INVENTION

The present invention relates to cushion cut gemstones exhibiting excellent optical brilliance. In particular, the present invention relates to a cushion-cut diamond with superior optical characteristics compared to that of industry standard cushion cut diamonds.

BACKGROUND OF THE INVENTION

One of the main characteristics of a diamond is light return or light performance, i.e., the amount of light returned to the eye from the diamond. The higher the light performance grade, the greater the brilliance (white light) and fire (colored light) of the diamond. Light performance is impacted by, among other things, the number, shape, angles and arrangement of the facets on the cut diamond. However, just increasing or decreasing the number and angle of the facets does not directly correlate to an increase in light performance. In fact, sometimes an increase in the number of facets can result in a diamond that is dull and lifeless, exactly the opposite of what is desired. It is the exact and precise combination of angles and facets that have to come together to create the perfect formula for the highest light return.

The cushion cut diamond is a diamond shape that was popular in the early 19th century and was so named because it was very similar to a plump cushion or pillow. The forerunner to the cushion-cut is the so-called Old Mine Cut, which was a square cut with rounded corners, deeply cut with a high crown, small table and large facets. The Old Mine Cut had 33 crown and 25 pavilion facets.

Many of the most famous gemstones in the world are cushion-cuts, including the blue Hope Diamond (45.52 cts), the Regent Diamond (140.5 cts) and the yellow Tiffany Diamond (128.54 cts). The largest cut blue sapphire in the world, the 423 ct Logan Sapphire in the Smithsonian Museum of Natural History, is a cushion-cut.

The cushion cut diamond has gained in popularity in recent years as a more distinctive alternative to the traditional round brilliant cut. Typical cushion-cut diamonds contain from 58 to 64 facets. However, even with this number of facets, compared to round brilliant cut diamonds, typical cushion cut diamonds available to consumers lack both fire and brilliance.

SUMMARY OF THE INVENTION

Thus, it is an object of the present invention to enhance the brilliance of cushion cut diamonds so they rival the brilliance and light performance of ideal cut round brilliant diamonds.

An additional object of the present invention is to have the cut stone appear larger than a typical modified cushion cut stone. Specifically, the cushion cut diamond of the present invention generally appears 10% larger than that of a typical modified cushion cut stone because the extra "half-moon" facets of the typical modified cushion cut stone are not present.

The cushion cut diamond of the present invention includes a substantially rectangular, preferably square, girdle; a crown extending in a first direction from the girdle; and a pavilion extending in a second direction from the girdle opposite the first direction. The cushion cut diamond has 69 uniquely arranged and angled facets, 41 of which are in the crown, and 28 of which are in the pavilion. The height of the crown is preferably between 12 to 19½% of the width of the stone, the total depth of the stone is preferably between 58-68% of the width of the stone, and the width of the table is preferably between 55-65% of the width of the stone.

The crown has four sides, rounded corners, a table, eight star facets surrounding the table, four side kite facets positioned between the two star facets on each side of the gemstone, four corner kite facets positioned between opposed star facets at each corner of the gemstone, and twenty-four upper half facets around the girdle.

In the preferred embodiment, the eight star facets are cut at an angle of approximately 21-31°, the four side kite facets are cut at an angle of approximately 35-45°, the four corner kite facets are cut at an angle of approximately 30-40°, and the upper half facets are cut at an angle of approximately 40-50°. All of these angles are relative to a plane parallel to the surface of the table.

The twenty-eight facets of the pavilion include four main pavilion facets extending from each respective corner of the gemstone to the culet, and six (6) lower half facets between each of the four main pavilion facets. Preferably, and relative to a plane parallel to the face of the girdle, the four main pavilion facets are each at an angle of approximately 34-38°, and the lower half facets are each at an angle of approximately 35-43°.

The present invention's unique combination of angles and faceting creates exceptional fire and brilliance. Specifically, the present invention uses unique faceting and angles that achieve an average 95% ("Excellent") light performance, as per the Gem Certification & Assurance Lab (GCAL). Also, and unlike standard cushion cut diamonds that use the industry standard 58 to 64 facets, the present invention uses a unique combination of 69 facets (41 in the crown, and 28 in the pavilion), that achieve a Gemological Institute of America (GIA) grading of "Cushion Brilliant" with Excellent Polish and Excellent Symmetry. For cushion cut diamonds, this is an unexpected and extremely beneficial rating.

BRIEF DESCRIPTION OF THE DRAWINGS

The figures are for illustration purposes only and are not necessarily drawn to scale. The invention itself, however, may best be understood by reference to the detailed description which follows when taken in conjunction with the accompanying drawings in which.

DETAILED DESCRIPTION OF THE INVENTION

The present invention will next be illustrated with reference to the figures. Such figures are intended to be illustrative rather than limiting and are included herewith to facilitate the explanation of exemplary features of embodiments of the present invention. Unless otherwise noted, the figures are not to scale, and are not intended to serve as engineering drawings.

Figure 1:
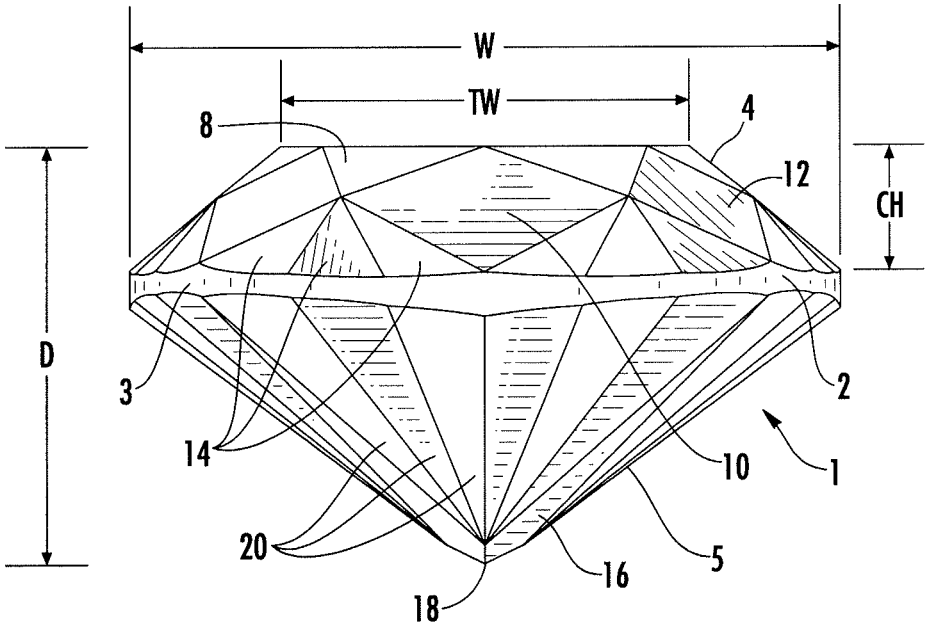
FIG. 1 is a side elevational view of a gemstone according to the present invention.

Referring now to the drawings, FIG. 1 is a side elevational view of a cushion cut diamond 1 according to the present invention. Although the following description relates to a cushion cut diamond, it will be readily apparent to one of skill in the art that the unique angles and faceting described herein can be applied to any precious or semi-precious gemstone.

As shown in FIG. 1, the cushion cut diamond 1 includes a substantially rectangular girdle 2 having rounded corners 3, a crown 4 extending upward from the girdle 2, and a pavilion 5 extending downward from the girdle 2. It is preferred that the cut diamond 1 has a length-to-width ratio of 1 or greater. For example, for a cushion-cut diamond having a square appearance, it is preferred that the length-to-width ratio is between 1 and 1.05; and for a cushion-cut diamond having a more rectangular shape, it is preferred that the length-to-width ratio is greater than 1.15. It is also preferred that the girdle thickness is 1% to 7% of the width W of the gemstone, i.e., from "thin to very thick." The crown 4 has a height CH of approximately 12 to 19½% of the width W of the stone (all percentages are based on the width W of the stone equaling 100%). The total depth D of the stone is approximately 58-68% of the width W of the stone.

Figure 2:
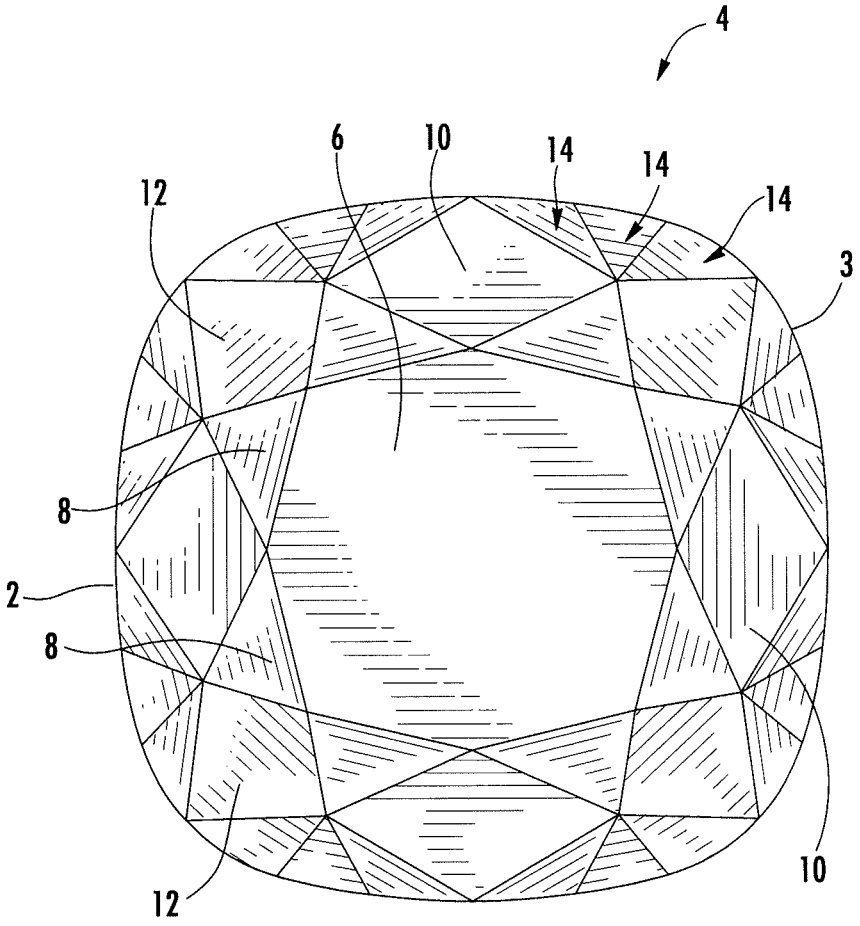
FIG. 2 is a top view of the gemstone shown in FIG. 1.

FIG. 2 is a top view showing the crown 4 of the cushion cut diamond of FIG. 1. As shown in FIG. 2, the crown 4 includes 41 uniquely angled and arranged facets. These 41 facets include a table 6, eight star facets 8 surrounding the table 6 (with two star facets on each side of the gemstone), four side kite facets 10 positioned between the two star facets 8 on each side of the gemstone, four corner kite facets 12 positioned between opposed star facets 8 at each corner 3 of the gemstone, and twenty-four upper half facets 14 around the girdle 2. Preferably, a set of three upper half facets 14 are positioned between each side kite facet 10 and corner kite facet 12. As shown in FIG. 1, the table 6 has a width TW of between 55-65% of the width W of the stone.

In the preferred embodiment, the eight star facets are cut at an angle of approximately 21-31°, the four side kite facets are cut at an angle of approximately 35-45°, the four corner kite facets are cut at an angle of approximately 30-40°, and the upper half facets are cut at an angle of approximately 40-50°. All of these angles are relative to a plane parallel to the surface of the table. The particular shape, dimensions and angle relative to the plane parallel to the surface of the table 6 of these facets will depend on the symmetry and dimensions of the stone being cut.

Given the above-described arrangement of the crown facets, and as shown in FIG. 2, each respective side of the crown 4 is defined and bordered by two respective corner kite facets 12, and includes two star facets 8, a side kite facet 10, and six upper half 14. In addition, and as shown in FIGS. 1 and 2, the corners 3 of the cushion cut diamond are rounded. The particular radius of the corners 3 is not limited.

Figure 3:
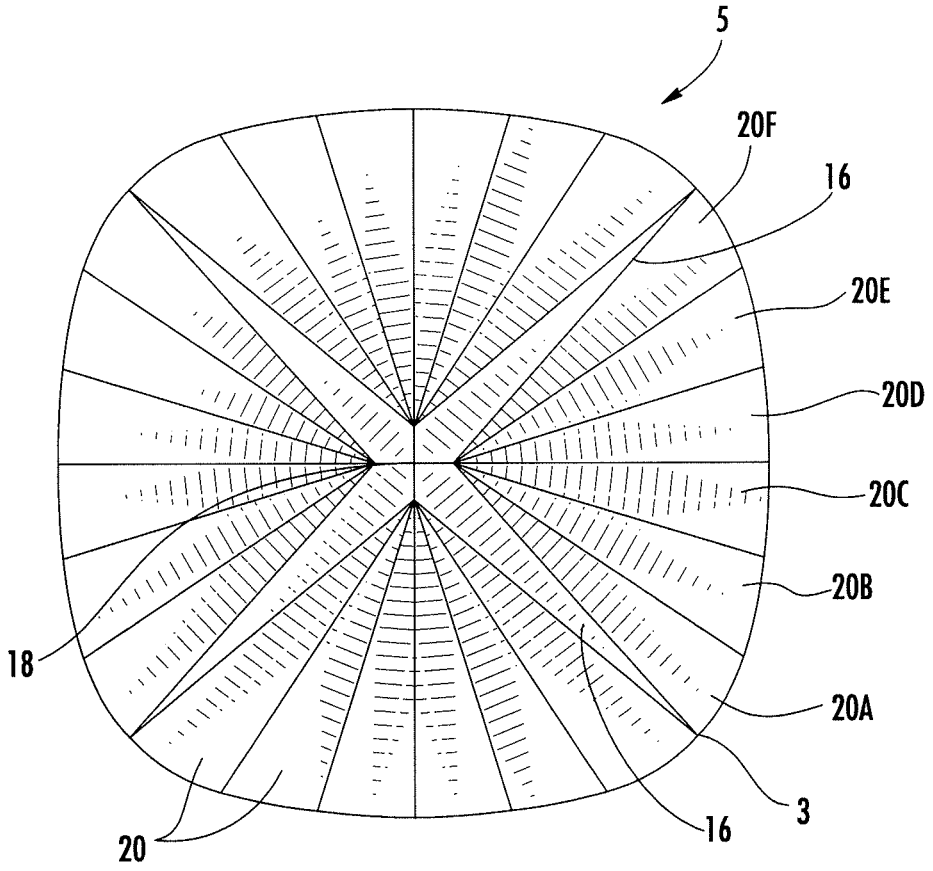
FIG. 3 is a bottom view of the gemstone of FIG. 1.

Turning now to FIG. 3, the pavilion 5 of the cut diamond 1 of FIG. 1 is shown. The pavilion 5 includes 28 uniquely angled and arranged facets. These 28 facets include four main pavilion facets 16 extending from each respective corner 3 of the cut diamond 1 to the culet 18. Specifically, each of the four main pavilion facets 16 extends from a position corresponding to a tip of a corner kite facet 12 to the culet 18. These main pavilion facets 16 are preferably cut at an angle of approximately 34-38° relative to a plane parallel to a face of the girdle 2. Although the present invention is not limited in the style of the culet used, the culet 18 is preferably a pointed culet (i.e., 0% of the width of the gemstone) to a substantially flat culet having an area of 3% or less of the width of the gemstone.

Between each of the four main pavilion facets 16, the gemstone is divided by six (6) lower half facets (for a total of 24 lower half facets). These lower half facets 20 are preferably cut at an angle of approximately 35-43° relative to a plane parallel to a face of the girdle 2. The particular shape, dimensions and angle relative to the plane parallel to the face of the girdle 2 of the lower half facets 20, however, will depend on the symmetry and dimensions of the particular stone being cut.

Preferably, these six (6) lower half facets are further divided into two lower half facets 20A and 20F proximal to the main pavilion facets, two lower half facets 20C and 20D distal from the main pavilion facets, and intermediate lower half facets 20B and 20E between each of the proximal and distal lower half facets. The outermost lower half facets 20A and 20F proximal to the main pavilion facets 16 are preferably cut at an angle of approximately 35-40°, the intermediate lower half facets 20B and 20E are preferably cut at an angle of approximately 37-42°, and the innermost lower half facets 20C and 20D distal from the main pavilion facets 16 are preferably cut at an angle of approximately 38-43°.

The present invention's unique combination of angles and faceting creates exceptional fire and brilliance. Specifically, the present invention's use and arrangement of the unique faceting and angles achieves an average 95% ("Excellent") light performance, as per the Gem Certification & Assurance Lab (GCAL), and achieves a Gemological Institute of America (GIA) grading of "Cushion Brilliant" with Excellent Polish and Excellent Symmetry. Accordingly, unlike standard cushion cut diamonds, the present invention uses a unique combination of 69 facets (41 in the crown, and 28 in the pavilion).

Although the present invention has been described in relation to particular embodiments thereof, many other variations and modifications will become apparent to those skilled in the art. Therefore, the present invention should not be limited by the specific disclosure herein, but only by the appended claims. For example, although the present invention has been described with respect to a cut diamond, the unique angles and faceting can be equally applied to all precious or semi-precious stones to achieve enhanced brilliance and light performance.

What is claimed is:

1. A gemstone comprising:

a substantially rectangular girdle having rounded corners;

a crown extending in a first direction from the girdle, the crown having a table, four sides, and four corner kite facets each positioned at a respective rounded corner, each of the four sides including:

two star facets adjacent the table;

a side kite facet positioned between the two star facets;

a first set of three upper half facets positioned on a first side of the side kite facet; and a second set of three upper half facets positioned on a second side of the side kite facet; and a pavilion extending in a second direction from the girdle, opposite the first direction, wherein a height of the crown is between 12 to 19½% of a width of the gemstone, a width of the table is between 55-65% of the width of the gemstone, the four corner kite facets are at an angle of approximately 30-40° relative to a first plane parallel to a surface of the table, the two star facets are at an angle of approximately 21-31° relative to the first plane, the side kite facet is at an angle of approximately 35-45° relative to the first plane, and the first set of three upper half facets and second set of three upper half facets are at an angle of approximately 40-50° relative to the first plane, the pavilion includes four main pavilion facets each of which extend from the respective rounded corner to a bottom of the pavilion, and six lower half facets between each of the four main pavilion facets, the four main pavilion facets are each at an angle of approximately 34-38° relative to a second plane parallel to a face of the girdle, and the six lower half facets are each at an angle of approximately 35-43° relative to the second plane.

2. The gemstone according to claim 1, wherein each of the four main pavilion facets extends from a position corresponding to a tip of a corresponding corner kite facet.

3. The gemstone according to claim 1, wherein the bottom of the pavilion is a culet.

4. The gemstone according to claim 3, wherein the culet has an area of 3% or less of the width of the gemstone.

5. The gemstone according to claim 1, wherein the girdle is substantially square.

6. The gemstone according to claim 1, wherein the gemstone has a length-to-width ratio of 1 or greater.

7. The gemstone according to claim 6, wherein the length-to-width ratio is between 1 and 1.05.

8. The gemstone according to claim 6, wherein the length-to-width ratio is greater than 1.15.

9. The gemstone according to claim 1, wherein a depth of the gemstone is between 58-68% of the width of the gemstone.

10. The gemstone according to claim 1, wherein a thickness of the girdle is 1% to 7% of the width of the gemstone.

11. The gemstone according to claim 1, wherein the gemstone has an average 95% light performance characteristic.

12. The gemstone according to claim 1, wherein the six lower half facets include:

two lower half facets proximal to the main pavilion facets and at an angle of approximately 35-40° relative to the second plane;

two lower half facets distal from the main pavilion facets and at an angle of approximately 38-43° relative to the second plane; and an intermediate lower half facet between each of the proximal and distal lower half facets and at an angle of approximately 37-42° relative to the second plane.

* * * * *